United States Patent [19]

Pelequin

[11] Patent Number: 5,038,497

[45] Date of Patent: Aug. 13, 1991

[54] PORTABLE CLOTHES DRIER

[76] Inventor: Andrew L. Pelequin, 606-3rd St., Fair Lawn, N.J. 07410

[21] Appl. No.: 617,185

[22] Filed: Nov. 23, 1990

[51] Int. Cl.[5] ..... F26B 13/00

[52] U.S. Cl. ..... 34/151; 34/202; 34/243 R

[58] Field of Search ..... 34/90, 91, 151, 202, 34/237, 238, 243

[56] References Cited

U.S. PATENT DOCUMENTS

| | | | |
|---|---|---|---|
| 3,577,650 | 5/1971 | Brahm | 34/151 |
| 4,578,881 | 4/1986 | Karlsson | 34/151 |
| 4,677,764 | 7/1987 | Cerny | 34/237 |
| 4,694,146 | 9/1987 | DeMars | 34/151 |
| 4,777,737 | 10/1988 | Wolens et al. | 34/237 |
| 4,856,206 | 8/1989 | Klein | 34/151 |
| 4,918,290 | 4/1990 | DeMars | 34/202 |
| 4,924,604 | 5/1990 | Colodner et al. | 34/151 |
| 4,959,911 | 10/1990 | Wolens et al. | 34/237 |

FOREIGN PATENT DOCUMENTS

| | | | |
|---|---|---|---|
| 1525253 | 3/1967 | France | 34/151 |

*Primary Examiner*—Henry A. Bennet
*Assistant Examiner*—Denise L. F. Gromada
*Attorney, Agent, or Firm*—William T. Hough

[57] ABSTRACT

A hot-air portable clothes drier has a carrying handle, two separate first and second casings one telescopically mateable within the other. Both casings include homogeneously dispersed hot-air exhaust ports directing exhaust air in a common direction. Each has outer cover portions with linearly extending elongated strips spaced-apart from one another. Elongated strips of a first casing mateably and telescopically intermeshing with those of a second casing. The elongated strips of each casing having free-space therebelow in the extended state and overlapping to cover and encase their opposite hot-air exhaust ports when in a retracted position of intermeshed portable intermittently locked state. Air intake ports in the first casing are channeled to direct intake air into contact with hot-air heating electrical elements powered by electricity through a retractable electric cord having in electrical series circuit therewith a rheostat and rheostat handle which is manually adjustable and setable at any temperature setting ranging from about room temperature up to about 100° C. at the exhaust ports of the two casings. Other duct structure channels air from the heating elements to the exhaust ports of the first and second casings, with duct structure casings mateably telescoping into each other to the retracted position. In electrical series with the rheostat is an air circulation fan positioned to draw air into the air-intake ports, to propel that air past the heating elements, and to exhaust that heated air through the exhaust ports when switched on by an off-on switch.

23 Claims, 5 Drawing Sheets

PORTABLE CLOTHES DRIER

This invention is directed to a novel portable clothes drier.

PRIOR ART

While no truly relevant prior art is known nor located during a preliminary novelty search, prior art of interest is as follows. Cerny U.S. Pat. No. 4,677,764 discloses a grill having a fan blowing electrical heating element heated air upwardly through the grill on which clothing is to be positioned, with or without enclosure structure. DeMars U.S. Pat. No. 4,918,290 discloses another enclosed container with exhaust-port lid provided providing a space in which a folded towel may be position, with fan-driven heated air driven through the space, the air heated by an electrical heating element. Hansen et al. U.S. Pat. No. 4,199,873 discloses a small box-like flatly foldable compartment into which a small article may be positioned on an apertured support through which air may be driven by a conventional electrically heated hot air hair blower.

BACKGROUND

Prior to the present invention, there has existed problems of how to quickly dry a minor amount of clothing such as a blouse, socks, stockings, pantyhose, underwear or the like, when quantity of available clean clothing is limited when in the course of a business trip or vacation or within a rented room of a hotel, motel or dormitory where a conventional or large clothes drier is not readily available or impractical for limited washed clothing in need of prompt timely drying. Heretofore, standard practice has included typically hanging such wet items on the shower-curtain bar or on the bath tub or bathroom lavatory or on the towel racks or on chair backs, or on a radiator, or over a heating vent, or the like, creating an unsightly appearance and a nuisance to other persons using the bathroom. Many times, the person is in dire need of quick drying of the item(s), having solely the above-noted alternatives. There has not heretofore existed anything of a small and portable nature that may be conveniently carried on trips, much less having the appearance similar to a suit case. Currently available drying apparatuses such as disclosed in the preceding prior art patents are plagued by the limited drying space. Also, often it is desired or essential to be able to spread the wet or damp item over a large area to prevent wrinkling during drying or to facilitate prompt or rapid drying, as opposed to cramming or folding the item into a small or inadequate drying space.

Another problem or difficulty encountered by prior small clothes driers has been the safety hazard in their used, as a result of water drainage from wet or damp clothing placed in close proximity to electrical wiring and/or heating elements, resulting in a hazardous possibility of fire and/or electrocution or severe electrical shock to the user.

OBJECTS OF THE INVENTION

Accordingly, of the invention include the overcoming and/or avoiding of problems and/or difficulties above-noted.

More particularly, another object is to obtain novel benefits and advantages not heretobefore available relative to the above-noted background discussion and prior art.

Another is to obtain a portable clothes drier adapted to and suitable for short trips.

Another object is to obtain a small portable clothes drier providing large amounts of support and drying space.

Another object is to obtain a novel portable clothes drier having a compact but easily expandable structure.

Another object is to obtain a highly efficient clothes drier of small portable size.

Another object is to obtain a portable clothes washer of safe operation in drying damp or wet clothing.

Another object is to provide a portable clothes drier resembling a small suitcase or brief case.

Another is to provide a clothes drier of sufficiently small dimensions when compacted, as to be easily storable in small space, while providing large drying-space capacity during use, together with optimal speed and ease of compacting, handling and storage thereof.

Other objects become apparent from the preceding and following disclosure.

SUMMARY OF THE INVENTION

Broadly the invention may be described as a novel portable clothes drier as a novel combination as follows. The combination is a portable combination including a first plurality of serially interconnected separate casings interconnected by unifying means for fitting the first plurality together in an intermeshed portable state such that the combination is portable. The first plurality in an extended state each has a second plurality of heat exhaust ports spaced substantially homogeneously from each other. The second plurality of the first plurality are substantially all directed in a common direction relative to one-another when the first plurality is in an open functional state such that clothing to be dried may be positioned to extend across the second plurality. Air intake structure and mechanism thereof mounted within at-least one of the first plurality for taking-in air from atmosphere whereby the portable combination is utilizable for drying clothes when in the open functional state. The unifying structure and mechanism thereof include duct structure and mechanism thereof connected between the air intake structure and mechanism thereof and the first plurality, for circulating air from the intake structure and mechanism thereof to the second plurality such that the combination is portable, Power structure and mechanism thereof is mounted on at-least one of the first plurality for providing a source of electricity. An electric hot air heating structure and mechanism thereof are mounted on at-least one of the plurality for being powered by electricity and for thereby heating and circulating air drawn-in through the intake structure and mechanism thereof into the duct structure and mechanism thereof. The electric hot air heating structure and mechanism thereof are connected to the power structure and mechanism thereof as a source of electricity for energizing the hot air heating structure and mechanism thereof and are mounted on one of the first and second casings in a position such that air passed through the duct structure and mechanism thereof is heated at least one of before or after exiting through the second plurality.

In a first preferred embodiment, the electric hot air heating structure and mechanism thereof include electric heating elements connected to receive heat-generating electricity from the power structure and mechanism thereof, and there also is included switch structure and mechanism thereof for switching on and off electricity to the electric heating elements. This first preferred embodiment further includes heating element circuitry connected to the power structure and mechanism thereof adapted to provide electric power through the switch structure and mechanism thereof to the electric hot air heating structure and mechanism thereof.

In a further third preferred embodiment as an improvement on the second preferred embodiment, the first plurality includes at least first and second casings, the intake structure and mechanism thereof being mounted within the first intake structure and mechanism thereof, and in this third preferred embodiment the second plurality includes first and second sets of the heat exhaust ports. The first set of heat exhaust ports are mounted on the first casing and the second set of heat exhaust ports are mounted on the second casing. In this embodiment, the duct structure and mechanism thereof includes first ducts mounted within the first casing positioned and connected to direct heated air through the first heat exhaust ports, and includes the second ducts mounted within the first and second casing positioned and connected between to direct heated air through the second heat exhaust ports. Also in this third embodiment, the first ducts are of a first cross-sectional area, and the second ducts are of second larger cross-sectional area as compared to the first ducts such that rate and quantity of exhaust of heated air through the first and second ducts are substantially equal for each of the first and second ducts.

In a further fourth preferred embodiment, as an improvement on the third embodiment, the unifying structure and mechanism thereof include mating structure by which one of the first and second casings telescopically is slidable into a remaining other of the first and second casings into the intermeshed portable intermittently locked state.

In a further fifth preferred embodiment, as an improvement on the fourth embodiment, the unifying structure and mechanism thereof include each one or more of the second duct(s) having separate but linearly aligned proximal and distal portions, one of the proximal and distal portions being telescopically mated within a remaining other of the proximal and distal portions. Thereby the proximal and distal portions telescope one substantially fully within the other into the intermeshed portable intermittently locked state.

In a further sixth preferred embodiment, as an improvement on the fourth embodiment, a carrying handle structure and mechanism thereof is mounted on at-least one of the first and second casings. Thereby the combination is adapted to be carried as a portable combination when in the intermeshed portable intermittently locked safe.

In a seventh preferred embodiment, as an improvement on the third preferred embodiment, the first casing has a first edge and the second casing has a second edge, and the unifying structure and mechanism thereof include hinge structure and mechanism thereof pivotally connecting the first and second edges. Thereby the first and second casings are pivotally foldable to the intermeshed portable intermittently locked state.

In a further eighth preferred embodiment, as an improvement on the seventh preferred embodiment, the duct structure and mechanism thereof includes at-least one flexible tubular structure extending between the first and second casings adapted to channel at least a major portion of air from the electric hot air heating structure and mechanism thereof to the second heat exhaust ports. Thereby drying capability is expanded from the first to also the second casing.

In a further ninth preferred embodiment, as an improvement on the eighth preferred embodiment, a carrying handle structure and mechanism thereof are mounted on at-least one of the first and second casings. Thereby the combination is adapted to be carried as a portable combination when in the intermeshed portable intermittently locked state.

In another embodiment, as a tenth preferred embodiment as an improvement on the broadest combination as described previously above, the electric hot air heating structure and mechanism thereof includes fan structure and mechanism thereof for causing air to be taken into the intake structure and mechanism thereof into the duct structure and mechanism thereof to and out of the second plurality.

In further eleventh preferred embodiment, as an improvement on the tenth preferred embodiment, the switch structure and mechanism thereof are further for manually regulating intensity of energizing of the electric hot air heating structure and mechanism thereof whereby temperature of air exhausted through the second plurality is adjustable and controllable. In this embodiment, the switch structure and mechanism thereof include a rheostat and a manually adjustable handle therefor adapted to regulate amount of electricity feedable to the electric hot air heating structure and mechanism thereof.

In a further twelfth preferred embodiment, as an improvement on the tenth preferred embodiment, the rheostat limits temperature to a maximum of about 100 degrees for air exhausted at the second plurality.

In another preferred thirteenth embodiment, as another improvement on the broadest embodiment of the invention previously described, a carrying handle structure and mechanism thereof is mounted on at-least one of the first and second casings whereby the combination is adapted to he carried as a portable combination when in the intermeshed portable intermittently locked state.

In another preferred fourteenth embodiment, as another improvement on the broadest embodiment of the invention previously described, the electric hot air heating structure and mechanism thereof are further for limiting the temperature of air exhausted at the second plurality to a range up to about 100 degrees Fahrenheit.

In another preferred fourteenth embodiment, as another improvement on the broadest embodiment of the invention previously described, the electric hot air heating structure and mechanism thereof include a manually adjustable rheostat and a manually adjustable handle therefor adapted to regulate amount of electricity feedable to the electric hot air heating structure and mechanism thereof such that temperature of air exiting from the second plurality is limited to a maximum of about 100 degrees Fahrenheit.

In another preferred fifteenth embodiment, as another improvement on the broadest embodiment of the invention previously described, there is provided within each of the first and second ducts a water-collection structure for collection of water dripping from wet clothing suspended or supported on or above the first and second heat-exhaust ports. Such water-collection structure serves multiple purposes. First and most important, such structure prevents the drainage of moisture toward and into contact with the electrical circuitry and/or heating elements, thereby preventing potential fire, electric shock to the user, burning-out or electrical shorting-out of circuitry, and the like. Additionally, any drainage water thereby intermittently collected by such vessel-like structure is quickly vaporized by the hot air passing over the collected water, passing the vapor into the room to maintain optimal humidity that otherwise could become too low as a result of prolonged heat-production from the heating elements. Another function of the water collection structure is to avoid collection of water within one or more of the casings, such trapped water in the absence of a collection structure potentially causing deterioration and/or destruction of the casing, circuitry and other parts of the composite combination device.

In another preferred sixteenth embodiment, as another improvement on the broadest embodiment of the invention previously described, the hot-air heating electrical elements powered by electricity through a retractable electric cord in the first casing whereby the combination become fully portable in its intermeshed portable intermittently locked state.

In an alternate and more preferred embodiment, there are provided separate fans or blowers, and separate heating elements, for separately each hinged casings with a single on-off switch and a single reastatic switch and reostat thereof for each of the separate casings, operatively connected by appropriate circuitry (wires) as described hereinbelow. Additionally and more preferably, the control switches above-noted are mounted on a recessed surface within one of the casins, such that they are not exposed to exterior hazards of breakage or manipulation. This embodiment may also includes other preferred features previously noted above.

The invention may be better understood by making reference to the following diagrammatically illustrative Figures.

THE FIGURES

FIG. 1 diagrammatically illustrates a preferred embodiment of the invention, in a top plan view thereof in its open or extended functional state.

FIG. 2 diagrammatically illustrates the same view as FIG. 1 of the same preferred embodiment, but in its closed or retracted storage and intermeshed portable intermittently locked state.

FIG. 3 diagrammatically illustrates a view as taken along line 3—3 of FIG. 1, in partial cross-sectional view.

FIG. 3A illustrates a view as taken along line 3A—3A of FIG. 3, in partial cross-sectional view, showing the relationship of the side walls of the second casing that telescope into the walls of the first casing.

FIG. 4 diagrammatically illustrates an in-part view in cross-section, as taken along line 4—4 of FIG. 1, illustrating the interlocking keys and slots for slidable and mated casing members instrumental in the mechanism of moving from the open to the closed state.

FIG. 5 diagrammatically illustrates an in-part view as taken along line 5—5, showing the air intake vent and various switches illustrated in FIG. 1.

FIG. 6A diagrammatically illustrates an alternate other embodiment opening in the same fashion as a suit case, shown is side partial cut-away and partial cross-sectional view, in its open functional state.

FIG. 6B diagrammatically illustrates the same embodiment as FIG. 6A but in the closed storage and intermeshed portable intermittently locked state.

FIG. 7A diagrammatically illustrates a preferred embodiment in a side cross-sectional view in an open operational state and position.

FIG. 7B diagrammatically illustrates a top view of the operational embodiment of FIG. 7A taken along lines 7B—7B of FIG. 7A.

FIG. 7C diagrammatically illustrates a view taken along line 7C—7C of FIG. 7A.

DETAILED DESCRIPTION

In the foregoing figures, common or related indicia are utilized for the same or related parts of corresponding functions for the different figures and/or different illustrated embodiments, to improve ease of following and understanding of the description of the invention. Once described, description of various indicia is not repeated except in certain instances to facilitate following and understanding.

Figure 1:
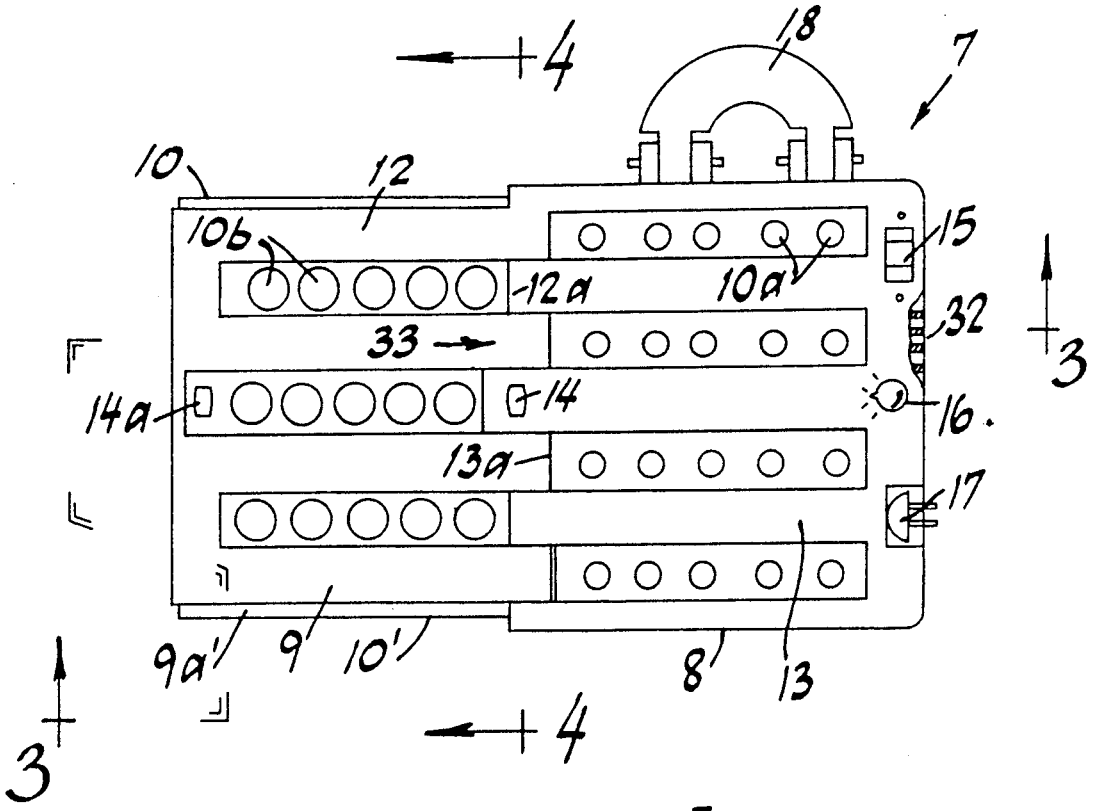

FIG. 1 diagrammatically discloses a preferred embodiment of the portable drier 7 having the first casing 8 and the second casing 9. Heated exhaust air is vented through the plurality of exhaust ports (vents) inclusive of the first set of exhaust ports **10*a* of the first casing and the second set of exhaust ports 10*b* of the second casing. The second set of exhaust ports and structure forming them as elongated members 12 are positioned to slide and telescope into slots 13*a* formed between the first set of exhaust ports and structure forming them as elongated members 12, such that the second casing can be slidably mated with the first casing to its intermeshed portable intermittently locked state. When in the closed state the opposing intermittently releasable latch members 14 and 14*a* become intermittently locked such that the casing 9 does not accidentally tend to slide from casing 8 while the drier unit 7 is being portably carried by handle 18. Within the casing 8 is a retractable electric cord and plug collectively represented by indicia 17 in the withdrawn (retracted) state by any conventional or other retraction spring mechanism, the electric power cord being operatively connected to the electric fan or blower 28 and the heating elements 26 through the rheostat having rheostat switch 16, and through the off-on switch 15. While the slot therefor is not illustrated in this view, the key 10** is shown in its extended state.

Figure 2:
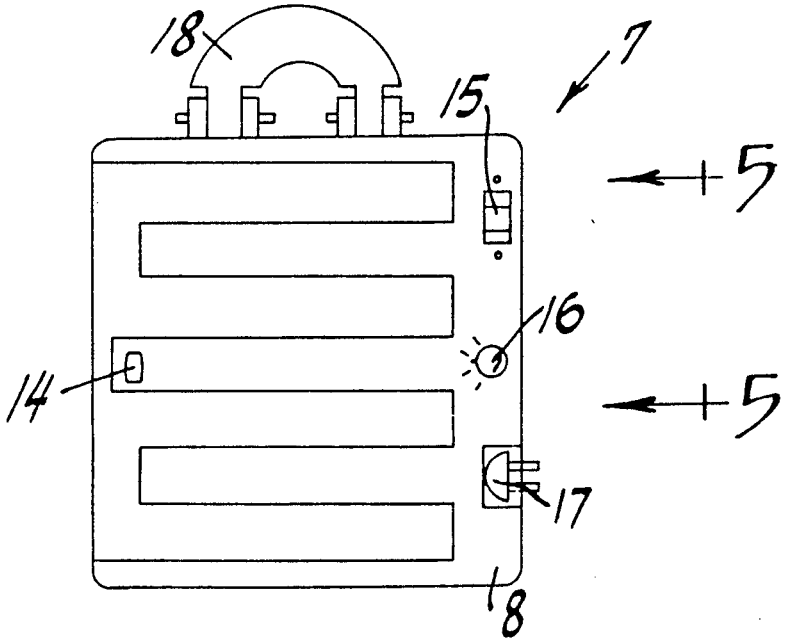

FIG. 2 illustrates the same embodiment as FIG. 1, except shown in the closed intermeshed intermittently locked state.

Figure 3A:
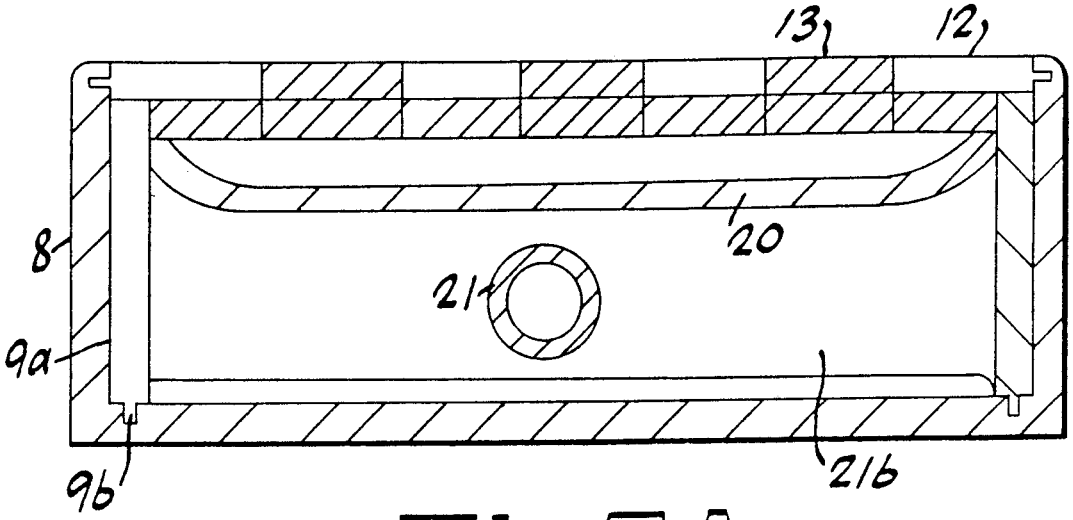
Figure 3:
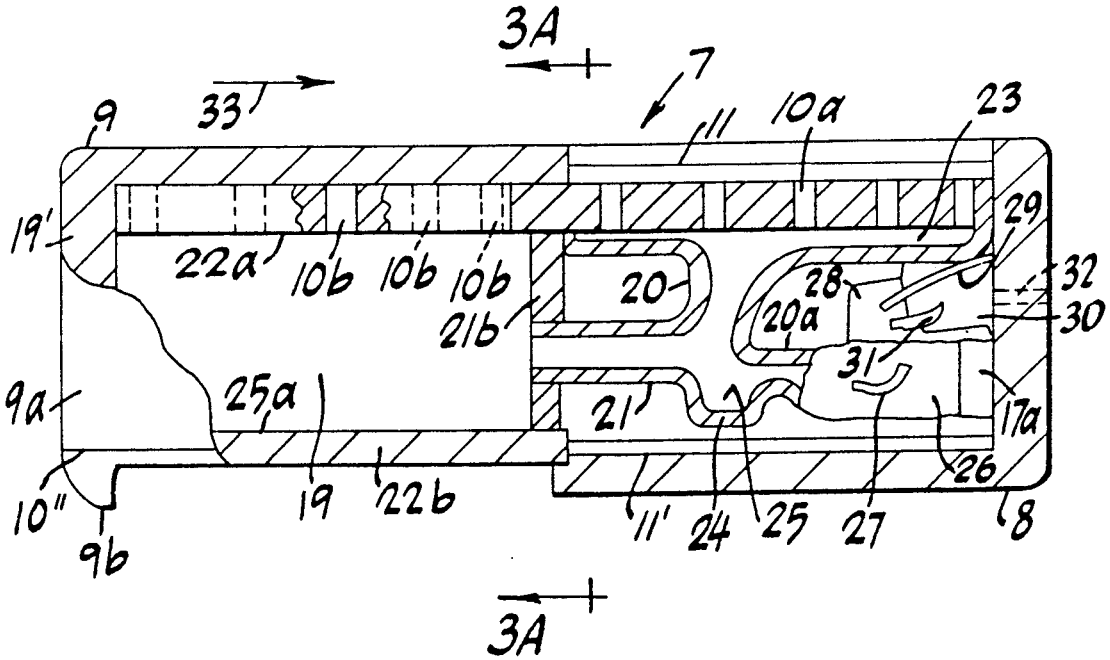

FIG. 3 illustrated the view taken along line 3—3 of FIG. 1, showing in the non-cut-away portion the second casing 9 with its downwardly-projecting edge portion serving as a leg flange **9*b* that provides end-support for the casing 9 in its extended state when resting on a table or on the floor or the like. In this view, the typical slot 11 that receives the aforestated key 10, is shown. Also the flange or key 10″ is illustrated, on the opposite side there being another identical flange or key (not shown) that mates with and slides within slot 11′. In the extended state of this view, there is the space 19 constituting duct-space enclosed by the box-like combination characterized as second duct structure including the second casing 9′*s* bottom member 22*b* and the side members 9*a* and 9*b* and the second elongated members 12, the end member 19′, with wall 21*b* and conduit 21 jointly constituting the male proximal end of the second casing's duct structure directing hot air to the space 19. The above-noted elements 22*b*, 9*a*, 9*b*** constitute the upright sides and bottom of the female distal end of the second casing's duct structure telescoping around the male proximal end of the second casing's duct structure, as shown in FIG. 3A, taken along line 3A—3A.

Figure 4:
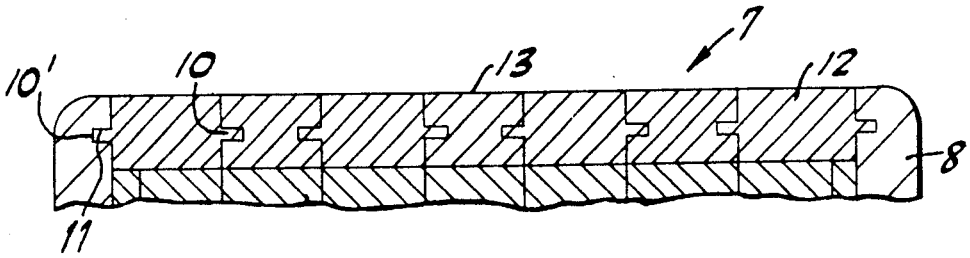

FIG. 4, as taken along line 4—4 of FIG. 1, illustrates a cross-sectional view at the union or junction point of the first and second casings, illustrating in particular the interlocking elongated members 12 and 13 by their respective flanges 10 and slots 11.

Figure 5:
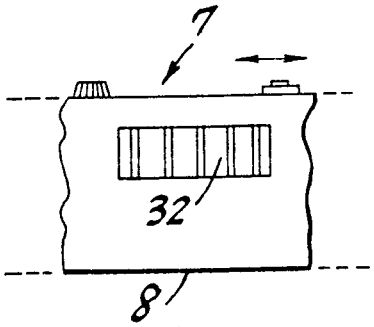

FIG. 5 as taken along line 55-5 illustrates a view of the end of the casing 8 with its air intake port or duct 32 for the embodiment of FIGS. 1 and 2.

Figure 6A:
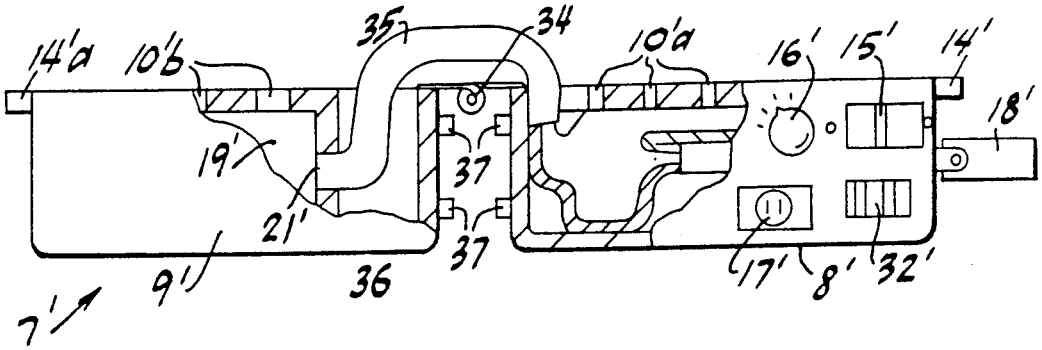
Figure 6B:
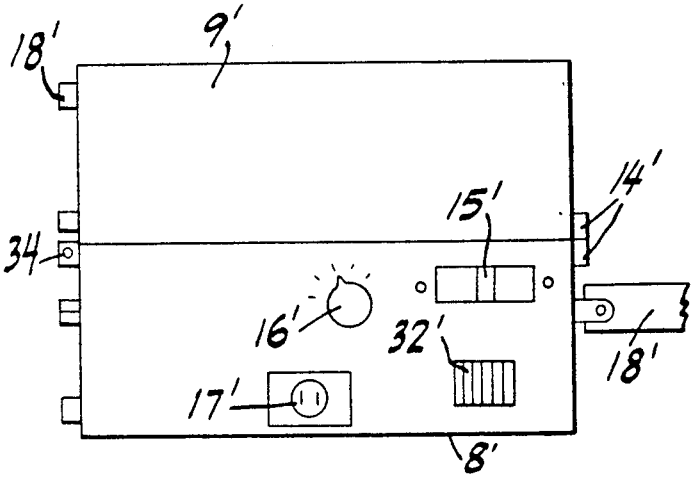

FIG. 6A illustrates a typical alternate embodiment opening in the manner, of a hinged suitcase with hinge 34, having the hot air conveyed to space 19' by flexible conduit 35 that may be folded into the second case's duct-storage space 36 when the first case 8' and the second case 9' are snapped together by the latches 14' and 14'a. There are rest (seating) nodules 37 as better illustrated in the typical appearing embodiment in the closed state of FIG. 6B.

Figure 7A:
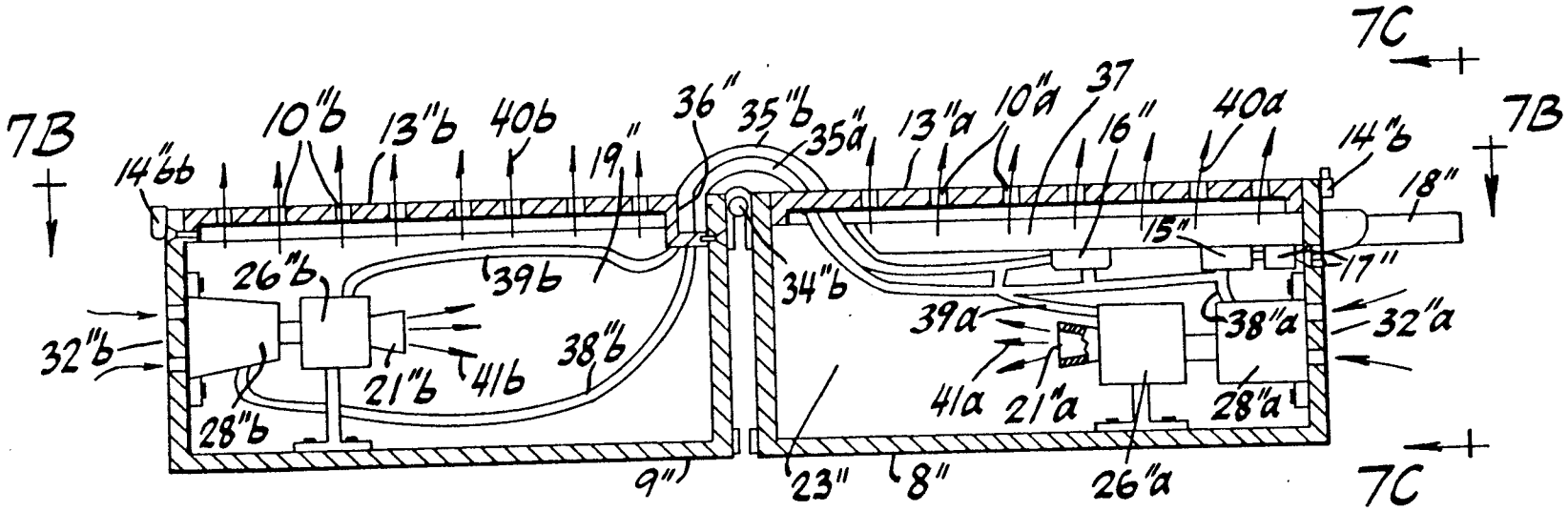
Figure 7C:
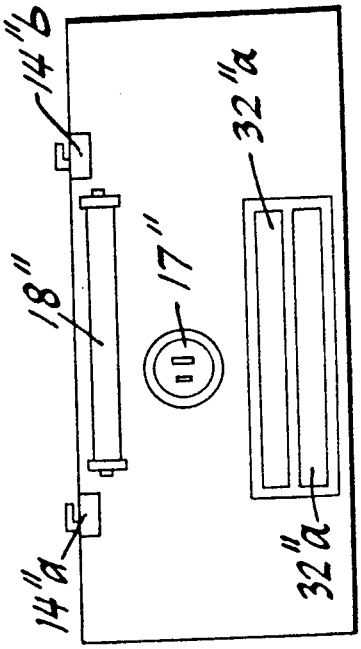
Figure 7B:
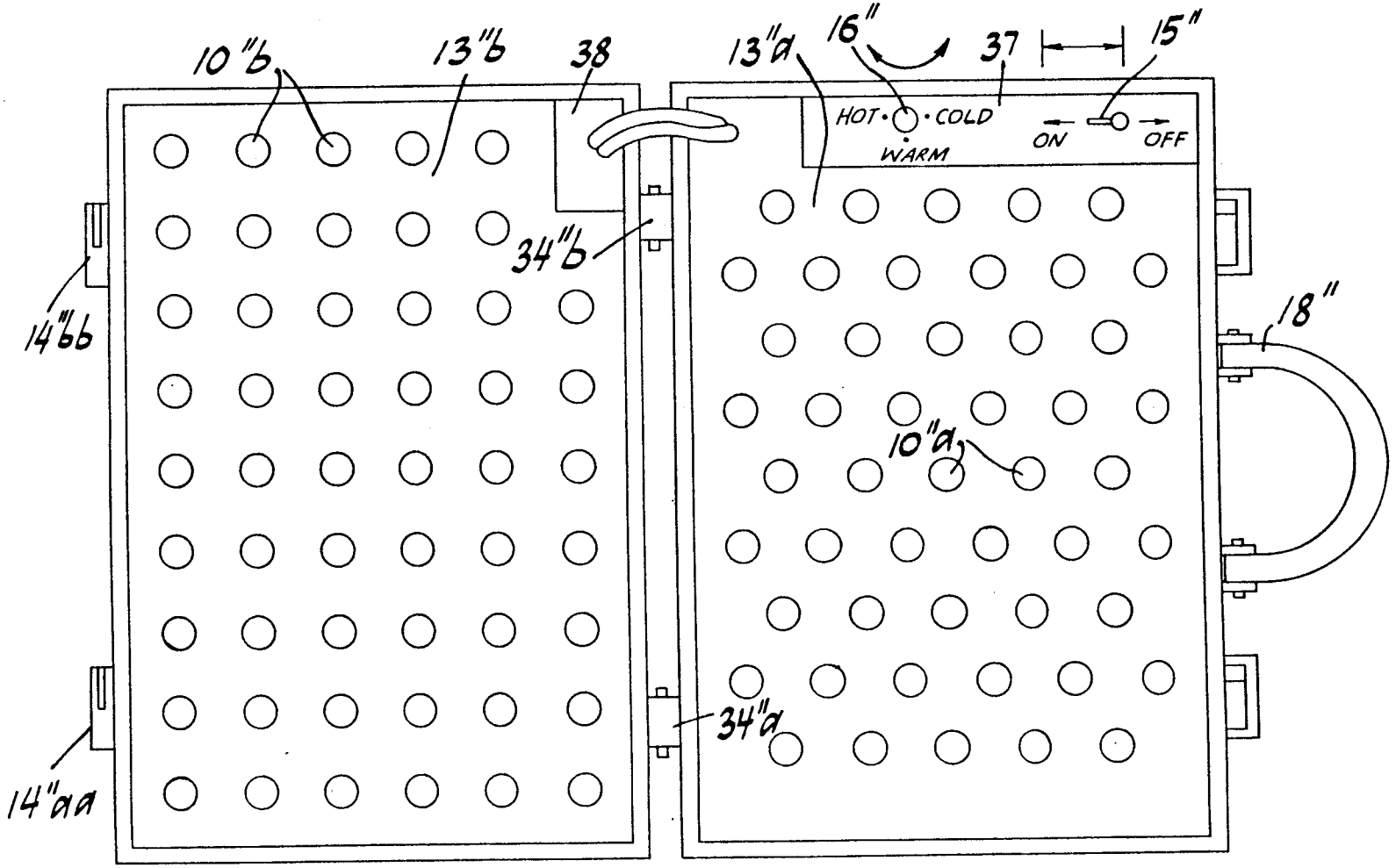

FIGS. 7A through 7C diagrammatically illustrate an alternate and preferred embodiment as follows. In the side cross-sectional embodiment of FIG. 7A, it is seen that the is a recessed portion 37 in the upper flattened structure 13''a and surface thereof, and as shown in FIG. 7B having the on-off switch 15'' and the reostat switch 16'' mounted on that recessed portion such that there are no exterior switches, all being enclosable when the cases 8 and 9 are in a closed latched state and position. Also it can bee seen that the switches in the casing 8 control the activity of the separate and dual fans and heating elements, a separate set separately positioned in each of the cases 8 and 9 interconnected by the wire 38''a and 38''b to the respective fans 28''a and 28''b and wires 39a and 39b to the respective heating elements 26''a and 16''b. Accordingly, for its respective separate fan, each of casings 8'' and 9'' has its separate air intake ports, namely air intake ports 32''a and 32''b. The air to dry clothes is blown from the inner vents 21''a and 21''b into the spaces 23'' and 19'' to subsequently be vented upwardly through vents 10''a and 10''b respectively as vented air 40''a and 40''b.

While the various non-electrical parts of the present invention may be composed of any of assorted well known substances for making casings and elongated telescoping members—such as saw-dust composite, fiberglass, raw-hide leather or artificial leather or any various plastics such as polypropylene, nylon or the like, the preferred material is polypropylene plastic because of its toughness and resiliency.

It is within the scope and contemplation of this invention to make such variations, substitutions of equivalents and modifications as would be apparent to a person of ordinary skill.

I claim:

1. A portable electric clothes drier, comprising in combination: a first plurality of serially interconnected separate casings interconnected by unifying means for fitting the first plurality together alternately intermittently in an open state and in an intermeshed portable intermittently locked state such that said combination is portable, the first plurality in an extended state each having a second plurality of heat exhaust ports spaced substantially homogeneously from each other, the second plurality being substantially all directed in a common direction relative to one-another when said first plurality is in an open functional state such that clothing to be dried may be positioned to extend across the second plurality, air intake means mounted within at-least one of said first plurality for taking-in air from atmosphere whereby the portable combination is utilizable for drying clothes when in the open state, said unifying means including duct means connected between said air intake means and said first plurality for circulating air from the intake means to the second plurality such that said combination is portable in the intermeshed portable intermittently locked state, power means mounted on at-least one of said first plurality for providing a source of electricity, and an electric hot air heating means mounted on at-least one of said plurality for being powered by electricity and for thereby heating and circulating air drawn-in through said intake means into said duct means, the electric hot air heating means being connected to the power means as a source of electricity for energizing said electric hot air heating means and being mounted on one of said first and second casings in a position such that air passed through said duct means is heatable at least one of before, during or after exiting through said second plurality.

2. A portable clothes drier according to claim 1, in which said electric hot air heating means includes electric heating elements connected to receive heat-generating electricity from said power means, switch means for switching on and off electricity to said electric heating elements and further includes heating element electric circuitry connected to said power means adapted to provide electric power through said switch means to said electric hot air heating means.

3. A portable electric clothes drier according to claim 2, in which said first plurality includes at least first and second casings, said intake means being mounted within said first intake means, said second plurality including first and second sets of said heat exhaust ports, said first set of heat exhaust ports being mounted on said first casing and said second set of heat exhaust ports being mounted on said second casing, said duct means including first ducts mounted within said first casing positioned and connected to direct heated air through said first heat exhaust ports, said second ducts being mounted within said first and second casing positioned and connected between to direct heated air through said second heat exhaust ports, said first heat exhaust ports being of first predetermined cross-sectional area and said second ducts being of larger second predetermined cross-sectional area as compared to the first heart-exhaust ports such that rate and quantity of exhaust of heated air through said first and second ducts is substantially equal.

4. A portable clothes drier according to claim 3, in which said unifying means includes mating structure by which one of said first and second casings telescopically is slidable into a remaining other of the first and second casings into said intermeshed portable intermittently locked state.

5. A portable electric clothes drier according to claim 4, in which said unifying means includes each said second ducts include linearly aligned proximal and distal portions, one of said proximal and distal portions being telescopically mated within a remaining other of said proximal and distal portions such that the proximal and distal portions telescope one substantially fully within the other into said intermeshed portable intermittently locked state.

6. A portable clothes drier according to claim 5, including a carrying handle means mounted on at-least one of said first and second casings whereby said combination is adapted to be carried as a portable combination when in said intermeshed portable intermittently locked state.

7. A portable electric clothes drier according to claim 3, in which said first casing has a first edge and said second casing has a second edge, and said unifying means including hinge means pivotally connecting said first and second edges such that said first and second casings are pivotally foldable to said intermeshed portable intermittently locked state.

8. A portable electric clothes drier according to claim 7, in which said duct means includes at-least one flexible tubular structure extending between said first and second casings adapted to channel at least a major portion of air from said electric hot air heating means to said second heat exhaust ports.

9. A portable clothes drier according to 8, including a carrying handle means mounted on at-least one of said first and second casings whereby said combination is adapted to be carried as a portable combination when in said intermeshed portable intermittently locked state.

10. A portable electric clothes drier according to claim 1, in which said electric hot air heating means includes fan means for causing air to be taken into said intake means into said duct means to and out of the second plurality.

11. A portable clothes drier according to claim 2, in which said switch means is further for manually regulating intensity of energizing of said hot air heating means whereby temperature of air exhausted through said second plurality is adjustable and controllable, said switch means including a rheostat and a manually adjustable handle therefor adapted to regulate amount of electricity feedable to said electric hot air heating means.

12. A portable electric clothes drier according to claim 11, in which said rheostat limits temperature to a maximum of about 100 degrees for air exhausted at said second plurality.

13. A portable electric clothes drier according to claim 1, including a carrying handle means mounted on at-least one of said first and second casings whereby said combination is adapted to be carried as a portable combination when in said intermeshed portable intermittently locked state.

14. A portable clothes drier according to claim 1, in which said electric hot air heating means is further for limiting the temperature of air exhausted at said second plurality to a range up to about 100 degrees Fahrenheit.

15. A portable electric clothes drier according to claim 1, in which said electric hot air heating means includes a manually adjustable rheostat and a manually adjustable handle therefor adapted to regulate amount of electricity feedable to said electric hot air heating means such that temperature of air exiting from said second plurality is limited to a maximum of about 100 degrees Fahrenheit.

16. A portable electric clothes drier according to claim 1, in which said duct means includes first and second ducts of which each thereof forms a separate a water-collection and holding structure adapted for collection of water dripping from wet clothing suspended or supported on or above the second plurality.

17. A portable electric clothes drier according to claim 1, in which said electric hot-air heating means includes electrical heating elements having connected thereto a retractable electric cord in the first casing adapted to provide electrical power to the electrical heating elements, whereby the combination is portable in its intermeshed portable intermittently locked state.

18. A portable electric clothes drier according to claim 12, in which said first plurality includes at-least first and second hinged-together casings, the first casing including a first set of said second plurality and the second casing including a second set of said second plurality, and in which said second plurality includes a first set of air exhaust ports mounted in the first casing and a second set of air exhaust ports mounted in the second casing, and in which said air intake means includes a first air intake means mounted in said first casing and a second air intake means mounted in said second casing, and including fan means for causing air to be taken into said intake means into said duct means to and out of the second plurality, and in which said fan means includes a first fan mounted in said first casing connected to direct air from said first air intake means to said first set of said second plurality and a second casing mounted in said second casing connected to direct air from said second air intake means to said second set of said second plurality, and in which said electric hot air heating means includes a first hot air heating means mounted in the first casing and a second hot air heating means mounted in the second casing positioned and the first hot air heating means being connected to be heatable of air traveling from said first intake means to said first set of said second plurality, and the second hot air heating means being positioned and connected to be heatable of air traveling from said second intake means to said second set of said second plurality, and in which said unifying means includes a first set of air ducts adapted and connected to conduct air from said first fan means to said first set of said first plurality and from said second fan means to said second set of said second plurality, 19. A portable electric clothes drier according to claim 18, including a carrying handle means mounted on at-least one of said first and second casings whereby said combination is adapted to be carried as a portable combination when in said intermeshed portable intermittently locked state.

20. A portable electric clothes drier according to claim 18, in which said electric hot air heating means is further for limiting the temperature of air exhausted at said second plurality to a range up to about 100 degrees Fahrenheit.

21. A portable electric clothes drier according to claim 18, in which said electric hot air heating means includes a manually adjustable rheostat and a manually adjustable handle therefor adapted to regulate amount of electricity feedable to said electric hot air heating means such that temperature of air exiting from said second plurality is limited to a maximum of about 100 degrees Fahrenheit.

22. A portable electric clothes drier according to claim 18, in which said duct means includes first and second ducts of which each thereof forms a separate a water-collection and holding structure adapted for collection of water dripping from wet clothing suspended or supported on or above the second plurality.

23. A portable electric clothes drier according to claim 18, in which said electric hot-air heating means includes electrical heating elements having connected thereto a retractable electric cord in the first casing adapted to provide electrical power to the electrical heating elements, whereby the combination is portable in its intermeshed portable intermittently locked state.

* * * * *

UNITED STATES PATENT AND TRADEMARK OFFICE

CERTIFICATE OF CORRECTION

PATENT NO. : 5,038,497

DATED : August 13, 1991

INVENTOR(S) : Andrew L. Peloquin et al

It is certified that error appears in the above-identified patent and that said Letters Patent is hereby corrected as shown below:

On the title page item [19] "Pelequin" should read --Peloquin--; and item [75] "Andrew L. Pelequin" should read --Andrew L. Peloquin--.

Signed and Sealed this

Seventh Day of April, 1992

*Attest:*

HARRY F. MANBECK, JR.

*Attesting Officer*

*Commissioner of Patents and Trademarks*